US006615502B2

(12) United States Patent
Newman

(10) Patent No.: US 6,615,502 B2
(45) Date of Patent: Sep. 9, 2003

(54) GABLE LEAD METHOD AND DEVICE

(75) Inventor: Roger L. Newman, Olsburg Pott. Co., KS (US)

(73) Assignee: OM2P, Inc., Manhattan, KS (US)

( * ) Notice: Subject to any disclaimer, the term of this patent is extended or adjusted under 35 U.S.C. 154(b) by 0 days.

(21) Appl. No.: 10/157,671

(22) Filed: May 29, 2002

(65) Prior Publication Data

US 2003/0005591 A1 Jan. 9, 2003

Related U.S. Application Data

(60) Provisional application No. 60/294,084, filed on May 29, 2001.

(51) Int. Cl.[7] ..... E04G 21/18
(52) U.S. Cl. ..... 33/407
(58) Field of Search ..... 33/407, 408, 409, 33/410, 413, 518, 404, 533; 211/119.1

(56) References Cited

U.S. PATENT DOCUMENTS

| | | | | | |
|---|---|---|---|---|---|
| 1,643,915 | A | | 9/1927 | Angelilli | 33/408 |
| 2,446,253 | A | * | 8/1948 | Tresidder | 33/409 |
| 2,629,178 | A | | 2/1953 | Zinken | 33/410 |
| 2,667,695 | A | * | 2/1954 | Price | 33/409 |
| 2,809,434 | A | | 10/1957 | Cordier | 33/407 |
| 2,811,778 | A | | 11/1957 | Snyder | 33/407 |
| 2,991,557 | A | | 7/1961 | Bongiovanni | 33/407 |
| 3,096,588 | A | | 7/1963 | Cook | 33/406 |
| 3,571,931 | A | | 3/1971 | Williams | 33/407 |
| 4,144,649 | A | * | 3/1979 | Huston | 33/409 |
| 4,329,786 | A | * | 5/1982 | Martinez | 33/409 |
| 5,125,162 | A | | 6/1992 | Prebeck | 33/408 |
| 5,129,150 | A | | 7/1992 | Sorensen | 33/408 |
| 5,392,523 | A | | 2/1995 | Hurt | 33/408 |
| 5,964,042 | A | | 10/1999 | Carper | 33/407 |
| 6,430,826 | B1 | * | 8/2002 | Sigl | 33/408 |

FOREIGN PATENT DOCUMENTS

| | | |
|---|---|---|
| DE | 1940755 | 2/1971 |
| FR | 997633 | 1/1952 |

* cited by examiner

*Primary Examiner*—Diego Gutierrez
*Assistant Examiner*—R. Alexander Smith
(74) *Attorney, Agent, or Firm*—Shook, Hardy & Bacon LLP

(57) ABSTRACT

A device having a pair of rails and a pair of guideline holders is provided. The rails are secured to the underside of the roof overhanging a gable. The rails define a slot within which the guideline holders are received. The guideline holders are slideable within the slot and may be releasably secured to any of a number of positions along the rails. A guideline is threaded within and releasably secured by each of the guideline holders.

17 Claims, 2 Drawing Sheets

FIG. 3.
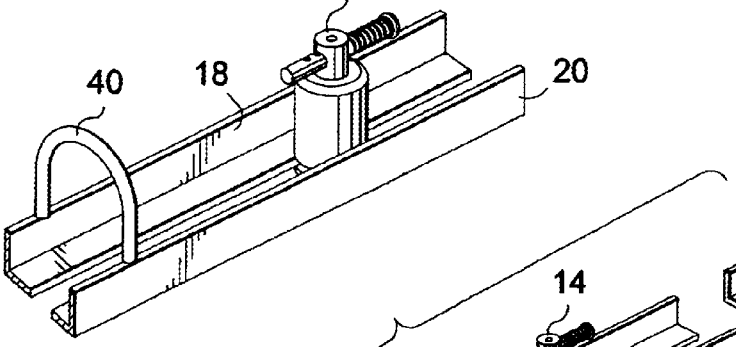
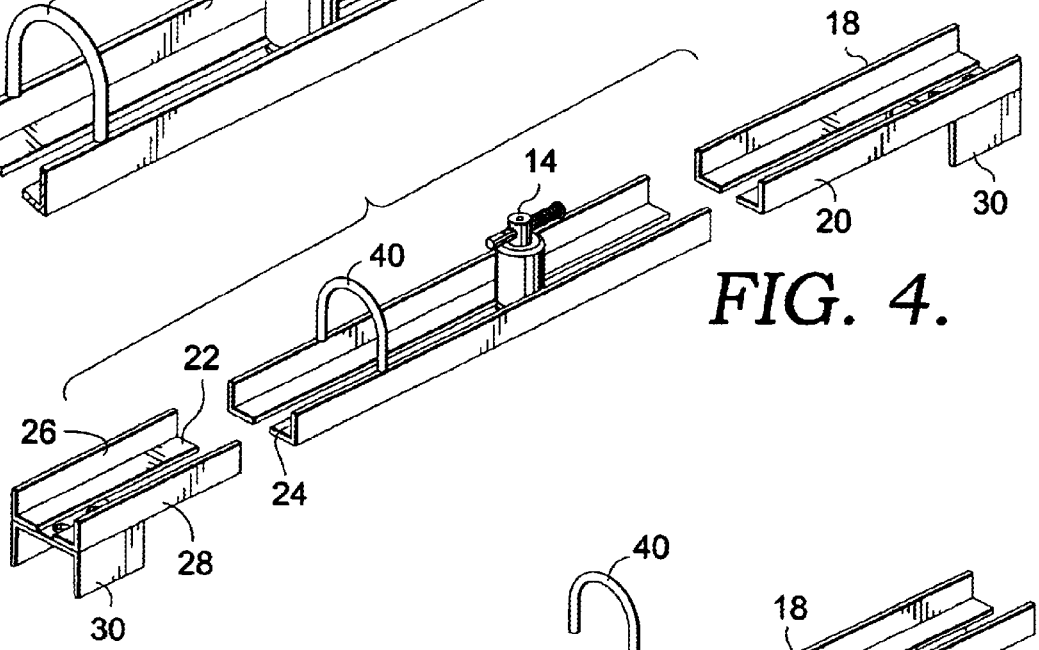
FIG. 4.
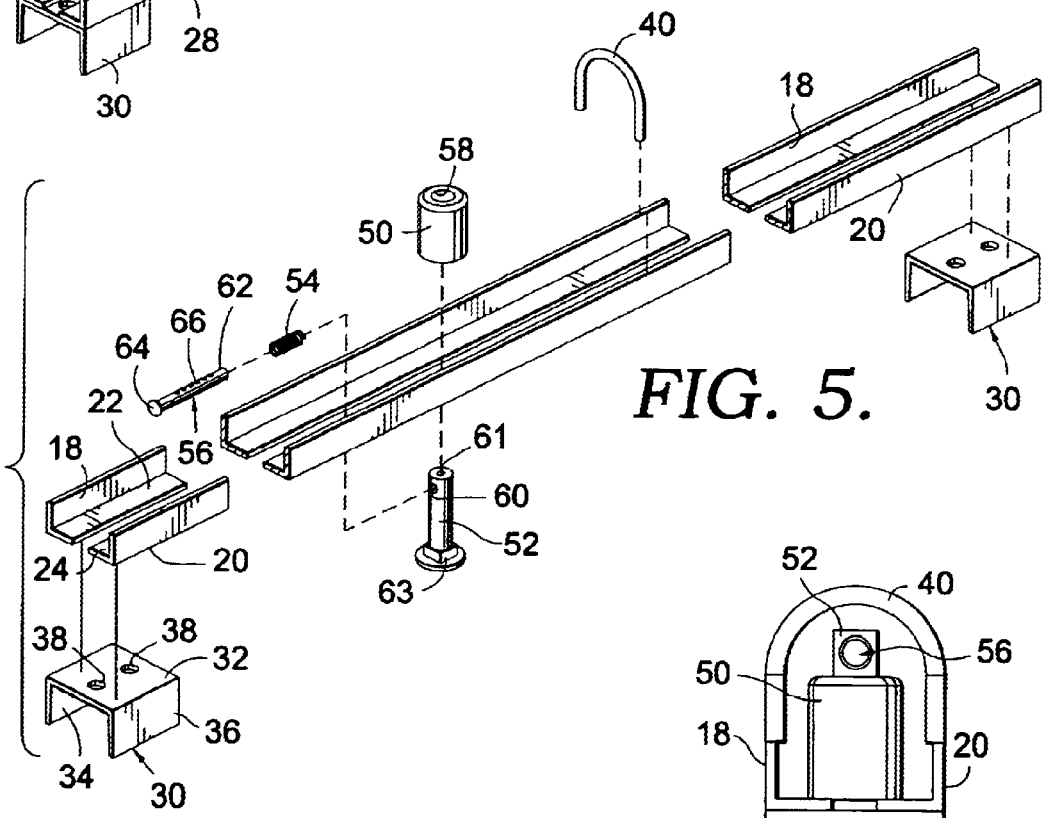
FIG. 5.
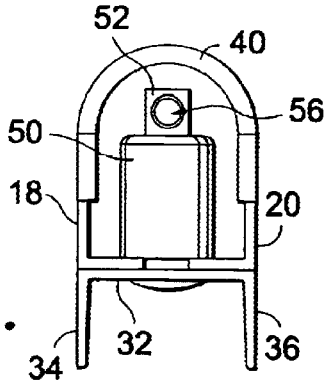
FIG. 6.

GABLE LEAD METHOD AND DEVICE

CROSS-REFERENCE TO RELATED APPLICATIONS

This application claims the benefit of U.S. Provisional Application No. 60/294,084 filed on May 29, 2001.

STATEMENT REGARDING FEDERALLY SPONSORED RESEARCH OR DEVELOPMENT

Not Applicable.

BACKGROUND OF THE INVENTION

This invention relates to a device and method for arranging bricks on a gable and, more particularly, to a device and method for positioning a guide line at each of a number of levels on a gable.

When constructing a bricked-in gable, it is often desirable to lay each course of bricks evenly across the span of the gable. In order to provide of an even course of bricks, a gable lead device or other type of level line is commonly used. Without using some type of guideline, the bricks in each course may be misaligned and uneven.

There have been various attempts to provide for a gable lead device for leveling a course of bricks when constructing a gable. An example of such a device is shown in U.S. Pat. No. 5,964,042 issued to Carper ("Carper") on Oct. 12, 1999. This arrangement provides for a pair of clamps, a pair of L-shaped angle irons and a guideline. The angle irons are mounted on the underside of the gable so that a first portion of the iron rests flush with the underside of the gable and an extended portion that extends perpendicularly from the surface of the gable. The clamps are coupled with the angle irons by sliding the extended portion within a channel formed in each of the clamps, and then tightening a screw to secure the clamps to each of the irons. The guideline is then extended between the clamps.

Prior art guideline devices suffer from a number of drawbacks and deficiencies. For instance, it is difficult to reposition the clamps on the angle irons. In order to change the position of the clamp on the irons, a user must use one hand to adjust the screw, and use the other hand to slide the clamp into position while holding the clamp on the iron. The use of two hands to position the clamps on the irons is time consuming and inconvenient. Furthermore, the clamp can completely slide off the iron when the clamps are being re-positioned on the irons or if the screw is inadvertently loosened. This leads to further inefficiencies in positioning the guideline.

Accordingly, there remains a need for a gable lead device that may be easily and efficiently used to lay an even course of bricks when constructing a gable. The present invention fills these needs as well as various other needs.

SUMMARY OF THE INVENTION

In order to overcome the above-stated problems and limitations, and to achieve the noted objects, there is provided a gable lead device that may be easily and efficiently used to adjust the position of a guideline when laying a course of bricks to form a gable.

In general, a device having a pair of rails and a pair of guideline holders is disclosed. The rails are secured to the underside of the roof overhanging a gable. The rails define a slot within which the guideline holders are received. The guideline holders are slideable within the slot and may be releasably secured to any of a number of positions along the rails. A guideline is threaded within and releasably secured to each of the guideline holders. Preferably, by depressing a single pin, the guideline may move relative to the pin to remove slack from the line when the holders are repositioned.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWING

The objects and features of the invention noted above are explained in more detail with reference to the preferred embodiment illustrated in the attached drawing figures, in which like reference numerals denote like elements, and in which:

FIG. 3 is a fragmentary perspective view of the gable device of the present invention;

FIG. 4 is a perspective view of the gable device of FIG. 3;

FIG. 5 is an exploded, perspective view of the gable device of FIG. 4; and FIG. 6 is a front elevation view of the gable device of FIG. 3.

DETAILED DESCRIPTION OF THE INVENTION

Figure 1:
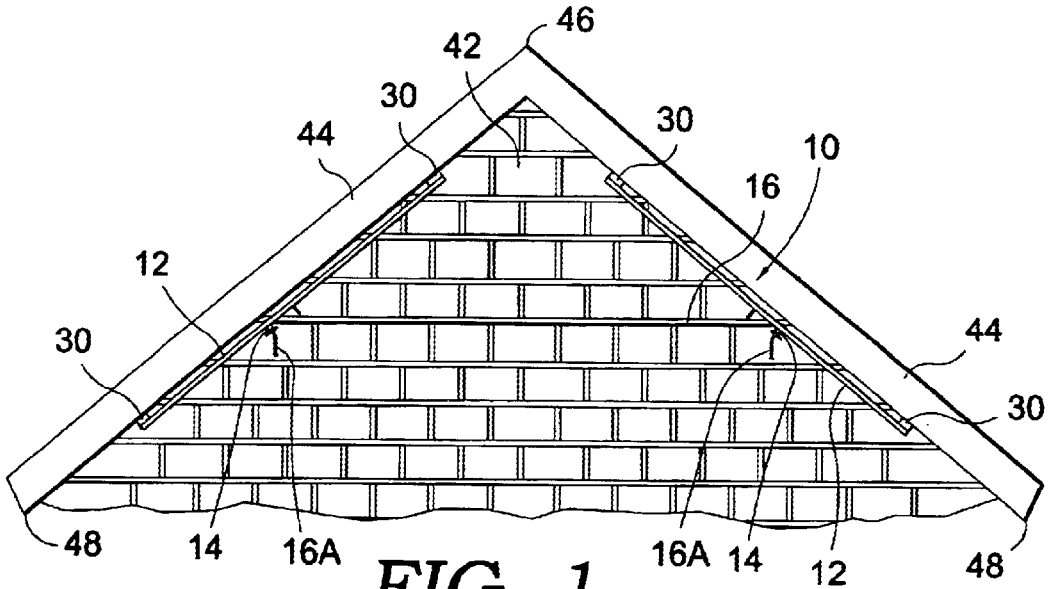
FIG. 1 is a front elevation view of a bricked-in gable with the gable lead device of the present invention.

Referring to the drawings in greater detail, the gable lead device of the present invention is shown in connection with a gable and designated generally by the numeral 10. The invention includes a pair of rails 12, a pair of guideline holders 14 and a guideline 16. With reference to FIG. 4, each rail 12 include a pair of angle irons 18 and 20. The angle irons 18, 20 have first bars 22, 24, and second bars 26, 28 angled normally from the respective first bars. The angle irons preferably have a length of about six feet. The angle irons are secured at a distance from one another to define a slot therebetween by a pair of mounting brackets 30 at either end of the angle irons. The slot is preferably has a width of about one half of an inch. As best shown in FIG. 5, each mounting bracket includes a base plate 32 and a pair of legs 34, 36 extending normally from either side of the base plate. Near the midline of the base plate 32 between the sides of the plate from which the legs extend, a pair of apertures 38 are located. On either side of the apertures 38, the base plate 32 is secured to the first bars 22 and 24 of angle irons 18 and 20, respectively. Preferably, the brackets 30 are welded to the angle irons. However, the brackets may be integrally formed, attached by nut and bolt fasteners, riveted or otherwise coupled with the angle irons. The angle irons are also secured to one another near the midpoint of each iron by a U-bar 40. Preferably, U-bar 40 is welded to the edge of the second bars 26 and 28 of either angle iron. The U-bar 40 stabilizes the rails 12 and helps maintain the width of the slot defined between the bars 22 and 24.

As shown in FIG. 1, a gable 42 and a pair of rakes 44 are shown. The gable 42 is the triangular portion of the endwall of a building. The rakes 44 extend beyond the surface of the gable and run from the ridge 46 (or apex) of the roof and terminate at the eave 48 of the roof. Each rail 12 is secured to the overhang of the roof located between the edge of the surface of the gable 42 and one of the rakes 44. Specifically, each rail 12 is placed at a specific distance from the gable, and is secured to the underside of the roof by placing screws (not shown) through the apertures 38 of the brackets 30 (FIGS. 3–6) and inserting the screws into the underside of the roof. As more fully set forth below, the upper ends of either rail are preferably located at the same distance from the underside of the ridge 46.

Figure 2:
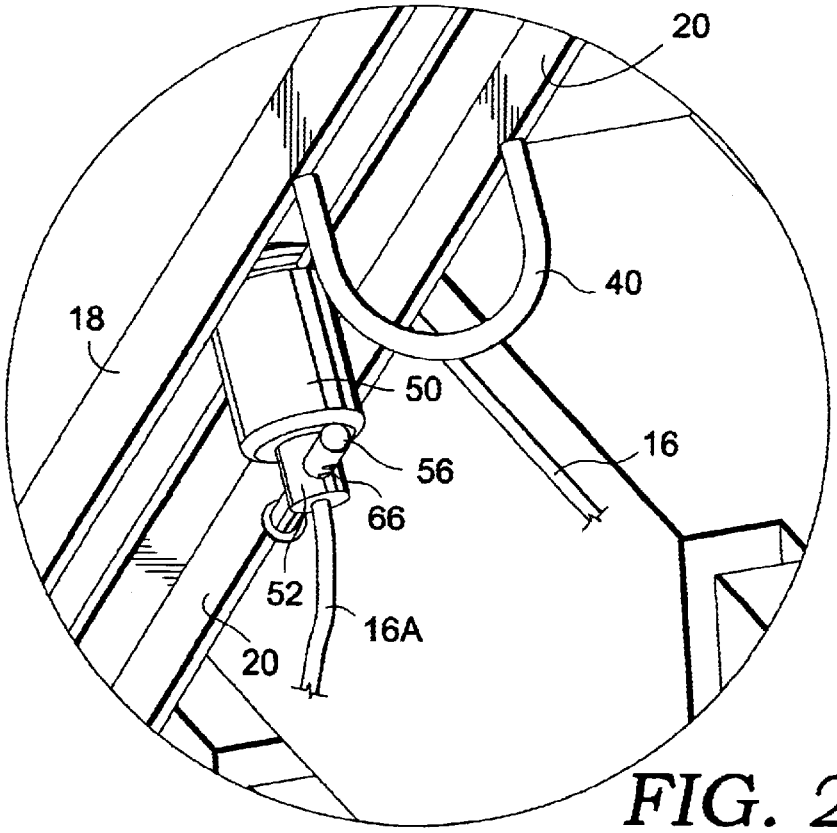
FIG. 2 is an enlarged perspective view of the gable device of the present invention.

With reference to FIG. 5, each guideline holder 14 includes a housing 50, a bolt 52, a spring 54 and a pin 56. The housing 50 is preferably annular and has an inner bore 58 with a radius of one-half inch and an outer radius at the exterior of the housing of about one inch. The inner bore 58 is preferably threaded near the bottom end of the housing. When the holder is assembled as discussed below, as best shown in FIG. 2, the bottom end of the housing 50 contacts the first bars 22 and 24. When located in proximity to the bars 22 and 24, the housing is capable of fitting within the area defined by the U-bar 40. The housing preferably has a textured surface to facilitate gripping of the housing when the gable The bolt 52 is preferably a carriage bolt having a half-inch radius and a length of one and a half inches. The bolt 52 has a transverse bore 60 located proximate its terminal end and preferably having a diameter of about one-fourth of an inch. The shaft of bolt 52 is placed through the slot defined between the first bars 18 and 20, and through the inner bore 58 of the housing 50. The base of the shaft preferably has a base section 63 with a squared cross section that fits within the slot between the bars 22 and 24 of the rails. Above the squared section 63, the bolt has a threaded area with threads matching those of housing 50. When the surface of the head of the bolt 52 contacts the first bars 18 and 20, the shaft of the bolt 52 extends beyond the end of the housing 50 so that the transverse bore 60 is cleared from the housing. The bolt 52 also has a longitudinal bore 61 extending along the entire length of the bolt.

Pin 56 is preferably a clevis pin having a shaft 62 (with a diameter of about one-fourth of an inch) and a head 64. A number of apertures 66 are located along the length of the shaft 62. When the bolt 52 is placed on one side of the rails and through the housing 50 as set forth above, the pin 56 may be placed through the transverse bore 60 in the bolt. The spring 54 is placed about the shaft 62 to bias the pin 56 away from the bolt 52.

As best shown in FIG. 2, the guideline 16 is placed through the longitudinal bore 61 of the bolt 52. Specifically, once the bolt 52 is placed within the housing 50, and the pin 56 is placed within the transverse bore 60 of the bolt, the pin 56 is depressed in the direction of the housing 50 so that one of the apertures 66 is aligned with the longitudinal bore 61. Preferably, when the spring is completely compressed, one of the apertures 66 comes into alignment with the longitudinal housing. By coming aligned when the spring is completely compressed, the alignment may be maintained by merely pressing on the head 64 until the head no longer moves relative to the bolt. Continuing to hold the pin 56 in this position, the guideline 16 is place through the bore 61 and the aligned aperture 66. Once the guideline is completely threaded through the bore, as shown extended around the first bar 24 of angle iron 20 in FIG. 2, pressure may be relieved from pin 56. The spring 54 biases the pin away from the bolt 52. Since the guideline 16 within the bore 61 is being pulled in the direction of the inner radius of the housing 50, the guideline is held against the housing 61 and cannot slide relative to the longitudinal bore 61. As shown in FIGS. 1 and 2 and discussed below, the EELS guideline 16 is placed through the top of one guideline holder 14, through the longitudinal bore 61, around the inner bar 20 (FIG. 2), and across to the other guideline holder 14.

In operation, the rails 12 are first secured to the underside of the roof at the appropriate position. Preferably, the lower end of each rail is placed at a position below the desired line of the first layer of bricks. The rails are typically placed at a constant distance of about three and a half to four and half inches from the gable so that the guideline will be in close proximity to the edges of the bricks when the bricks are place on the gable. When the rails are in the proper position, as mentioned above, screws are placed through the apertures 38 and into the underside of the roof.

Once the rails are in place, each of the guideline holders 14 are placed at a first position so that the holders 14 are at an equal vertical position relative to the ridge 46. Specifically, with a small turn of the housing 50 relative to the bolt 52, the space between the housing and bolt is greater than the first bars 22 and 24, and the holders are capable of being slid to the first position. When each holder 14 is in the desired position, the housing 50 is turned relative to the bolt 52 so that the housing and bolt are frictionally secured to the rails. A number of marks are placed on the rails to determine the vertical locations of the subsequent line of bricks. Since the rails are typically painted, pencil marks are typically made to indicate the lead line of the subsequent layers of bricks.

Before placing the first row of bricks on the gable, the loose end 16*a* (as shown in FIG. 2) extending through one of the place holders is pulled relative to the bolt 52 while depressing the pin 56. The end may either be manually pulled or a weight (not shown) located on the loose end may pull the guideline taut when the pin is depressed. On the guideline is taut, as shown in FIG. 1, the line is directed directly across the gable 42 and a row of bricks may be layed. As shown in FIG. 2, since the guideline wraps about the inner iron 20, the guideline is straight across nearly the entire width of the gable, and bricks may be placed at the appropriate orientation at the extreme edge of the gable.

Once the first row of bricks is laid, the guideline holders 14 are moved to a second position-a position preferably marked prior to placement of the first row of bricks on the gable. For instance, each layer of bricks may be placed about five and one half inches from the previous layer. Again, the guideline holders 14 are moved by unscrewing the housing 50 relative to the bolt 52 and sliding the holder 14 to the desired position, and tightening the housing to the bolt to maintain the holder at the second position. Once both guideline holders 14 are in the desired position, the pin 52 of one of the holders is depressed and the guideline drawn taut to create a reference line to lay the second layer of bricks. The process continues until the gable is completely bricked in. For larger gables, the rails 12 will be repositioned at least once on the underside of the roof on either side of the gable.

The present invention provides a method and device that allows a number of leads to be located quickly and accurately. As the guideline holders are moved from position to position, there is no risk that the holders will disengage the rails. Moreover, since only a slight turn of the housing, and a depression of the pin is required, the guideline holders may be operated by a single person, and may even be moved with only one hand. The rails allow the lineholders to be accurately positioned, and allows the straight guideline to extend from nearly one edge of the gable to another. Also, the rails may be pre-marked by the mason prior to bricking in the gable. In this respect, the mason may determine the number of course or layers needed to complete the gable prior to beginning the process. Thus, the mason can determine if adjustments must be made before reaching the final layers of the gable so that an equal and aesthetically pleasing distribution of bricks may be laid. Also, the gable may be adapted to fit any size overhang and any size of brick.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

For instance, the rails of the present invention have a one piece bar with a slot defined longitudinal along the bar, and the upstanding second bars of the angle irons eliminated. In another alternatively, the slot may be defined between a pair of circular rails, or rails having any of a number of cross sections. Solid blocks rather than the mounting brackets of the preferred embodiment may be used to secure the rails at either end. Additionally, a number of materials such as sheet metals, wood, and the like may be used for the rails.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A device for holding a guideline when laying a plurality of bricks on the surface of a gable, said device comprising:

a rail having a slot defined therein; and a first holder including a housing and a first pin, said first pin having a head and a shaft, wherein said shaft extends through said slot and is releasably secured to said housing when said rail is positioned between said head and said housing, wherein said first holder is selectively positionable on said rail by frictionally engaging said head and housing with said rail so that a guideline may extend across the gable;

wherein said first holder includes a channel defined along the longitudinal axis of said first pin and allows the guideline to pass therethrough.

2. The device of claim 1, wherein said first pin is threadably coupled to said housing.

3. The device of claim 1, wherein an aperture is defined in said first pin and further comprising a second pin adapted to fit within said aperture and having at least one hole defined therein to allow the guideline to pass therethrough.

4. The device of claim 3, further comprising a spring located between said first and second pin to releasably secure the guideline in said channel.

5. The device of claim 3, wherein the longitudinal axis of said aperture is transverse relative to the longitudinal axis of said first pin.

6. The device of claim 3, wherein said aperture is located proximate to the distal end of said shaft.

7. The device of claim 1, further comprising at least one mounting bracket coupled to said rail.

8. A method of laying a plurality of bricks on the surface of a gable, said method comprising:

providing a first rail and a second rail, said first and second rails each having a slot formed therein;

coupling said first and second rails at a distance from the gable;

providing a first holder and a second holder, each said holder comprising a housing and a first pin, said first pin having a head and a shaft;

sliding said shaft of first holder in the slot of said first rail and sliding said shaft of second holder in the slot of said second rail;

releasably clamping said first rail between said head and said housing of said first holder;

releasably clamping said first rail between said head and said housing of said second holder;

selectively positioning said first and second holders on said first and second rails respectively;

providing for a channel formed in said first pin; and locating a guideline between said first and second holders and threading the guideline through the channel.

9. The method of claim 8, wherein an aperture is defined in said first pin, wherein at least one hole is defined in a second pin to allow the guideline to pass therethrough, and further comprising a spring located between said first and second pins to releasably secure the guideline in said channel.

10. The method of claim 9, further comprising the steps of:

inserting said second pin in said aperture before threading the guideline through said channel; and threading the guideline through said channel and hole formed in said second pin.

11. The method of claim 10, further comprising:

using said spring to bias said second pin away from said first pin to secure the guideline in said channel.

12. The method of claim 11, further comprising:

moving said second pin toward said first pin; and sliding the guideline in said channel.

13. The method of claim 8, further comprising:

providing at least one mounting bracket; and coupling said rails to opposite rakes at a distance from the gable through the use of said at least one mounting bracket.

14. A device for holding a guideline when laying a plurality of bricks on the surface of a gable, said device comprising:

a rail means having a slot means defined therein;

a first holding means including a housing and a first pin, said first pin having a head and a shaft, wherein said shaft extends through said slot means;

means for releasably securing said housing to said rail means when said rail means is positioned between said head and said housing; and means for coupling the guideline to said first holding means, whereby said first holding means is selectively positionable on said rail means by frictionally engaging said first holding means to said rail means;

wherein said first holding means includes a channel means defined along the longitudinal axis of said first pin to allow the guideline to pass therethrough.

15. The device of claim 14, wherein an aperture is defined in said first pin, and further comprising a second pin adapted to fit within said aperture and having at least one hole defined therein to allow the guideline to pass therethrough.

16. The device of claim 15, further comprising a spring means located between said first and second pin for releasably securing the guideline in said channel means.

17. The device of claim 14, further comprising means for mounting said rail means to the gable.

* * * * *